US010728680B2

(12) United States Patent
Møller et al.

(10) Patent No.: US 10,728,680 B2
(45) Date of Patent: Jul. 28, 2020

(54) WAX FILTER SOLUTION FOR A SPEAKER OF HEARING AID

(71) Applicant: Oticon A/S, Smørum (DK)

(72) Inventors: Mathias Rask Møller, Smørum (DK); Kenneth Rueskov Møller, Smørum (DK); Jacob Holdt Hansen, Taastrup (DK); Jan Thor Lunddahl Larsen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/414,412

(22) Filed: May 16, 2019

(65) Prior Publication Data

US 2019/0356996 A1 Nov. 21, 2019

(30) Foreign Application Priority Data

May 17, 2018 (EP) ..... 18172898

(51) Int. Cl.
*H04R 25/00* (2006.01)

(52) U.S. Cl.
CPC ..... *H04R 25/654* (2013.01); *H04R 2460/17* (2013.01)

(58) Field of Classification Search
CPC H04R 25/654; H04R 2225/025; H04R 25/10; H04R 1/12; H04R 25/02; H04R 2460/17
See application file for complete search history.

(56) References Cited

U.S. PATENT DOCUMENTS 3,374,318 A * 3/1968 Martin ..... H04R 25/654 381/325
4,879,750 A * 11/1989 Nassler ..... H04R 25/654 381/325
4,945,569 A * 7/1990 Kulman ..... H04R 25/654 181/130
4,972,488 A * 11/1990 Weiss ..... H04R 25/654 381/322
5,278,360 A * 1/1994 Carbe ..... H04R 25/654 181/135
5,327,500 A * 7/1994 Campbell ..... H04R 25/654 381/322
5,347,584 A * 9/1994 Narisawa ..... H04R 25/602 381/323
5,864,628 A * 1/1999 Posen ..... H04R 25/654 381/322
6,795,562 B1 * 9/2004 Gunnersen ..... H04R 25/654 381/322

(Continued)

FOREIGN PATENT DOCUMENTS

DE 42 15 711 A1 12/1992
DE 42 32 317 A1 5/1993

*Primary Examiner* — Oyesola C Ojo
(74) *Attorney, Agent, or Firm* — Birch, Stewart, Kolasch & Birch, LLP

(57) ABSTRACT

A hearing aid comprising a speaker unit; a speaker snout defining a sound canal having a longitudinal axis, a lateral axis and a sound canal opening; an ear piece configured to be attached to the speaker snout and an ear wax filter. The sound canal is configured to guide sound generated by the speaker unit through the sound canal into the ear piece. The ear wax filter is slidably arranged in the speaker snout through a first opening allowing the ear wax filter to be radially inserted into the sound canal.

20 Claims, 5 Drawing Sheets

(56) References Cited

U.S. PATENT DOCUMENTS

| | | | | |
|---|---|---|---|---|
| 7,013,016 | B2 * | 3/2006 | Wolf | H04R 25/654 381/324 |
| 7,471,800 | B2 * | 12/2008 | Neilson | H04R 25/654 181/135 |
| 8,280,094 | B2 * | 10/2012 | Lehdorfer | H04R 1/1075 381/328 |
| 8,538,055 | B2 * | 9/2013 | Shennib | H04R 25/60 381/324 |
| 9,980,067 | B2 * | 5/2018 | Dorn | H04R 25/654 |
| 10,034,106 | B2 * | 7/2018 | van den Berg | H04R 25/654 |
| 10,136,232 | B2 * | 11/2018 | Karamuk | H04R 25/654 |
| 2007/0009106 | A1 * | 1/2007 | Tilson | H04R 25/654 381/60 |
| 2009/0154747 | A1 * | 6/2009 | Vestergaard | H04R 25/654 381/325 |
| 2011/0299712 | A1 * | 12/2011 | Bondo | H04R 25/654 381/325 |
| 2012/0014548 | A1 * | 1/2012 | van Halteren | H04R 25/60 381/325 |
| 2012/0250923 | A1 * | 10/2012 | Beck | H04R 25/654 381/328 |
| 2014/0247957 | A1 * | 9/2014 | Hagedorn-Olsen | H04R 25/654 381/328 |
| 2019/0110928 | A1 * | 4/2019 | Aase | A61F 11/08 |

* cited by examiner

WAX FILTER SOLUTION FOR A SPEAKER OF HEARING AID

FIELD

The present disclosure relates to a hearing aid comprising an ear wax filter. The disclosure is relevant for various hearing aids including receiver-in-the-ear (RITE) hearing aids and behind-the-ear (BTE) hearing aids.

BACKGROUND

In various types of hearing aids including receiver-in-the-ear (RITE) and behind-the-ear (BTE) models an ear wax filter is mounted on the tip that is inserted into the ear canal. An earpiece is usually mounted on top of the filter and attach to a mini-fit interface.

The earwax filter will gradually be filled with ear wax over time. Hereby, the acoustical performance of the hearing aid will gradually decrease or in some situations the ear wax filter will clog, whereby the hearing aid will be unfit for use.

The prior art filters are so small that they need to be attached to the tip by using a tool. In order to insert a prior art filter into a hearing aid, the hearing aid needs to clamp harder on the filter than the tool, to which the filter is attach to. Thus, leaving the ear wax filter in the hearing aid. Some hearing aid users experience that the hearing aid fails to clamp sufficiently to the ear wax filter over time. Since the ear wax filter interface gets worn and oily from ear wax, the hearing aid users are encouraged to change the ear wax filters themselves. But ear wax filter change can be very challenging for many hearing aid users.

Accordingly, it would be desirable to have a hearing aid provided with an ear wax filter that is easier to change by the hearing aid user.

It is an object of the present disclosure to provide a hearing aid having an ear wax filter that is easy to change for a hearing aid user.

SUMMARY

According to an aspect of the disclosure, the hearing aid comprises:

a speaker unit;

a speaker snout defining a sound canal, said sound canal having a longitudinal axis, a lateral axis and a sound canal opening, an earpiece configured to be attached to the speaker snout and an ear wax filter, said sound canal being configured to guide sound generated by the speaker unit through the sound canal into the earpiece, wherein the ear wax filter is slidably arranged in the speaker snout through a first opening allowing the ear wax filter to be radially inserted into the sound canal.

By mounting the ear wax filter from the side, it is possible to reduce the risk of pulling off the ear wax filter when removing the earpiece (a dome). Furthermore, the size of the ear wax filter can be increased so that the ear wax filter is easier to see and handle by the hearing aid user.

The speaker unit may be of any suitable type and size. It is preferred that the speaker unit is small so that the overall size of the hearing aid can be minimized.

The speaker snout comprises a sound canal extending along a longitudinal axis. The sound canal of the speaker snout moreover comprises a lateral axis and a sound canal opening.

The earpiece may have any suitable type and size as long as it is configured to be attached to the speaker snout. In one embodiment, the earpiece is a dome. The dome may be of any suitable type including open domes, closed domes and power domes.

The ear wax filter may have any suitable size. It is, however, preferred that the ear wax filter is so large that the hearing aid user easily can see and handle the ear wax filter.

The sound canal is configured to guide sound generated by the speaker unit through the sound canal into the earpiece. In one embodiment, the sound canal comprises a cylindrical portion. In one embodiment, the sound canal comprises a conical portion provided in the opposite end of the of the sound canal than the opening.

The ear wax filter is slidably arranged in the speaker snout through a first opening allowing the ear wax filter to be radially inserted into the sound canal. In one embodiment, the first opening has a basically constant cross-sectional area. Hereby, it is possible to slide the ear wax filter into the sound canal in a manner in which the ear wax filter seals against the portion of the speaker snout that defines the opening.

By the term "radially inserted into the sound canal" is meant inserted while being moved along a direction extending perpendicular to the longitudinal axis of the sound canal. Accordingly, it means that the ear wax filter is inserted into the speaker snout along a lateral axis of the sound canal. In an embodiment, the filter could be inserted with a 90 degree angle to the longitudinal axis of the speaker snout. However, it should also be noted that the filter could be inserted with an angle to the longitudinal axis lying between 60 to 120 degrees.

Instead of mounting the filter from the tip as in the prior art, the ear wax filters are mounted from the side of the speaker snout.

By having a hearing aid provided with a "side mounted" ear wax filter, it is possible to increase the size of the ear wax filter in order to make the ear wax filter easier to see and handle by the hearing aid user. Moreover, the "side mounted" ear wax filter is less sensitive to tolerances than the prior "tip mounted" ear wax filters.

According to another aspect of the disclosure, the ear wax filter comprises a first fixation structure configured to engage with a corresponding second fixation structure of said speaker snout.

Hereby, the it is possible to detachably attach the ear wax filter to the speaker snout in an easy and fast manner. The first fixation structure may have any suitable form enabling engagement with a corresponding second fixation structure of the speaker snout. The use of corresponding fixation structure makes it possible to provide a firm fixation of the ear wax filter to the speaker snout.

According to an even further aspect of the disclosure, the first fixation structure is an indentation structure and the second fixation structure is a protruding structure.

Hereby, it is possible to provide an easy, firm and fast attachment of the ear wax filter to the speaker snout.

According to another aspect of the disclosure, the first fixation structure is a protruding structure and the second fixation structure is an indentation structure. This configuration also provides an easy, firm and fast attachment of the ear wax filter to the speaker snout. The indentation structure constitutes a groove configured to receive a corresponding protruding structure.

According to a further aspect of the disclosure, the first fixation structure and the second fixation structure extend along the longitudinal axis of the speaker snout. Hereby, it is possible to provide a firm fixation of the ear wax filter to the speaker snout in an easy and fast manner. It is to be understood that the orientation of the fixation structure of the ear wax filter is defined in a configuration, in which the ear wax filter is arranged in the speaker snout.

In one embodiment, the first fixation structure is formed as a groove extending along an entire (basically plane) side of the ear wax filter.

In another embodiment, the first fixation structure is formed as a groove extending along only a portion of a basically plane side structure of the ear wax filter.

According to an even further aspect of the disclosure, the ear wax filter comprises two parallel plane side structures configured to engage into the first opening of the speaker snout. By applying parallel plane side structures, it is possible to slide the ear wax filter into the speaker snout.

Normally, inserting the ear wax filter from the side of the speaker snout through an opening will introduce an unsealed area. By providing the ear wax filter with two parallel plane side structures, it is possible to apply the ear wax filter to seal against the speaker snout.

According to another aspect of the disclosure, the ear wax filter comprises at least one arced side structure that constitutes a substantially flush surface with the speaker snout when the ear wax filter is arranged in the first opening.

Hereby, the arced side structure can close the opening in a manner in which the outer surface forms a continuous surface. Thus, the user can easily position the ear wax filter in a correct position.

According to another aspect of the disclosure, the speaker snout is provided with a second opening allowing the ear wax filter to be radially removed from the sound canal through said second opening.

Hereby, the second opening makes it possible to position the ear wax filter in an easier manner (both openings can be used to push the filter into the desired position). By the term "radially" is meant perpendicular to the longitudinal axis of the sound canal opening.

The openings are preferably provided in opposing sides of the speaker snout. In one embodiment, the openings are provided in a distance from the tip of the speaker snout, wherein said distance is smaller than the diameter of the sound canal opening.

According to a further aspect of the disclosure, the area of the first opening corresponds to the area of the second opening.

The use of openings having essentially the same area enables that both openings can be used for insertion and/or removal of the ear wax filter.

According to an even further aspect of the disclosure, the ear wax filter is arranged in a non-zero distance from the distal portion of the speaker snout, wherein the non-zero distance is smaller than the width of the ear wax filter.

By arranging the ear wax filter in a non-zero distance from the distal portion of the speaker snout, wherein the non-zero distance is smaller than the width of the ear wax filter, it is possible not to penetrate the flange and prevent damage of the flange during insertion of the ear wax filter into the speaker snout.

According to another aspect of the disclosure, the length of the ear wax filter essentially corresponds to the thickness of the speaker snout.

By applying an ear wax filter having a length that essentially corresponds to the thickness of the speaker snout it is easy to position the ear wax filter in the correct position simply by aligning the ear wax filter and the outer structure of the adjacent portion of the speaker snout.

According to a further aspect of the disclosure, the ear wax filter is arranged in a non-zero distance from the speaker unit, wherein the non-zero distance is larger than or equal to the width of the ear wax filter.

By providing the ear wax filter in a large distance (a distance that is larger than or equal to the width of the ear wax filter) from the speaker unit, it is possible to prevent ear wax from entering the sound canal of the speaker snout.

According to another aspect of the disclosure, the speaker snout comprises a flange configured to receive said earpiece and where a plane surface of the ear wax filter is arranged in said first opening so as to abut a surface of the flange.

Hereby, the flange enables that a reliable fixation can be accomplished.

According to an even further aspect of the disclosure, the ear wax filter is provided with a centrally arranged filtration zone comprising a lattice structure comprising a plurality of through-going bores or canals.

The plurality of through-going bores/canals allows sound to pass through the ear wax filter. At the same time the lattice structure prevents ear wax from passing through the ear wax filter.

According to another aspect of the disclosure, a solid structure surrounds the centrally arranged lattice structure.

The solid structure allows the ear wax filter to be handled by the hearing aid user.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1B:
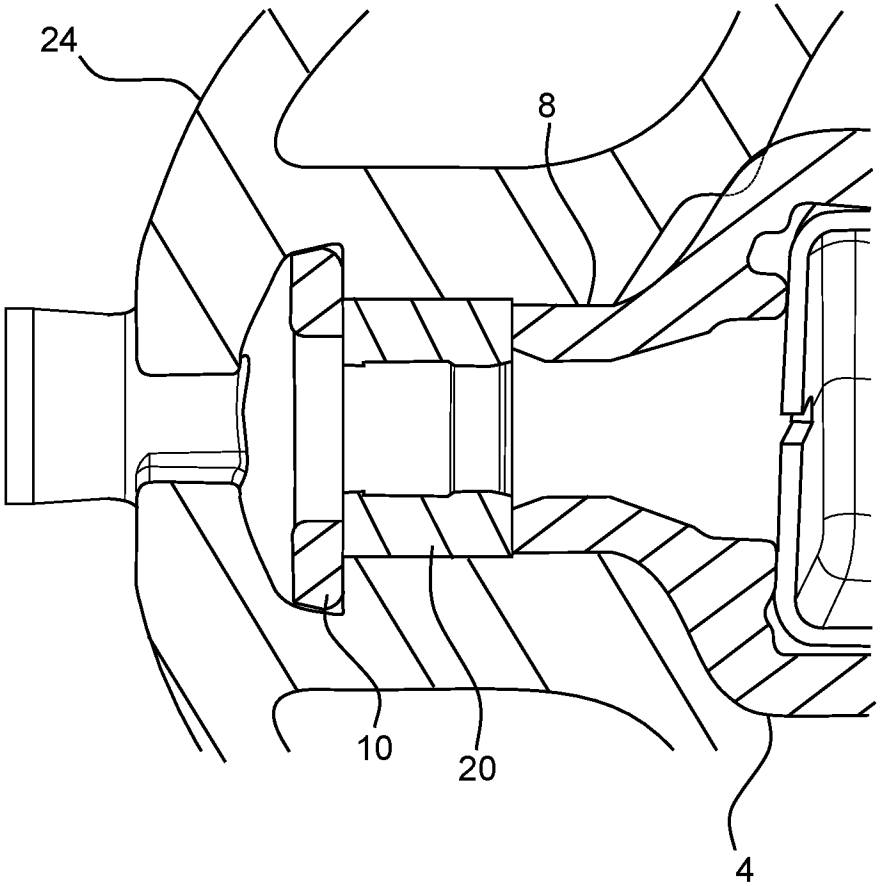
FIG. 1B shows a cross-sectional view of a hearing aid according to the disclosure.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a BTE type hearing aid, and/or ii) arranging the hearing device entirely or partly in the pinna and/or in the ear canal of the user such as in a RITE type hearing.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc.

Figure 1A:
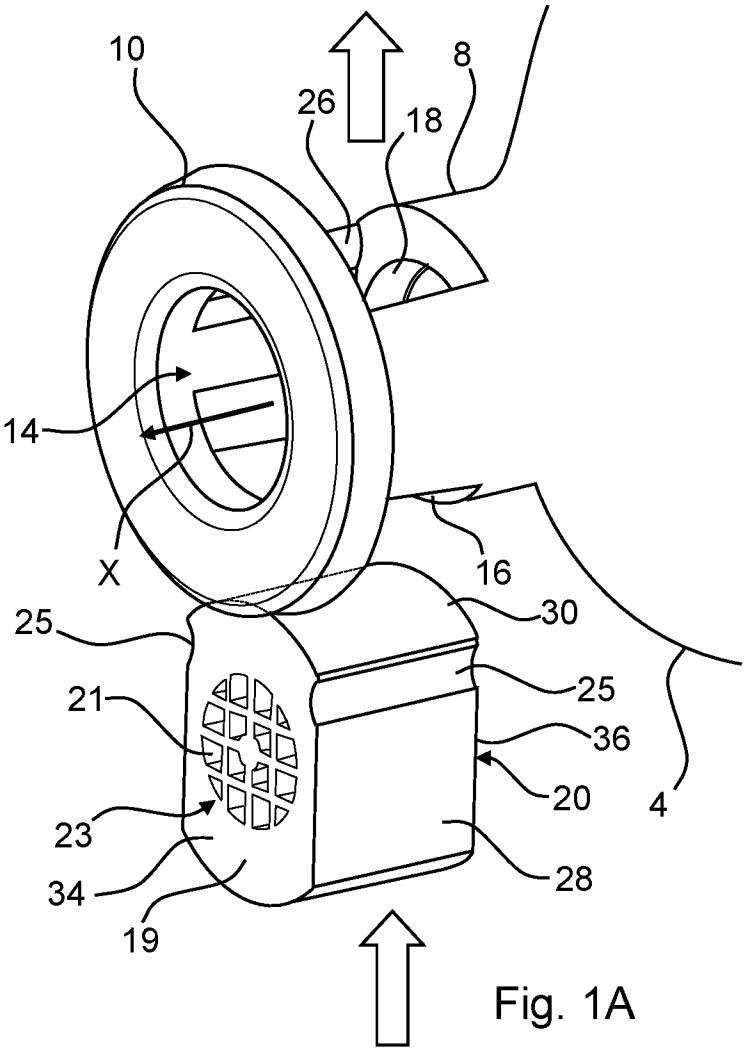
FIG. 1A shows a perspective view of an ear wax filter being inserted into a hearing aid according to the disclosure.

Now referring to FIG. 1A, which illustrates a portion of a hearing aid according to the disclosure. FIG. 1A illustrates a perspective view of an ear wax filter 20 being inserted into the hearing aid having a speaker body 4.

The hearing aid comprises a speaker snout 8 that is provided with a first opening 16 an opposing second opening 18. A fixation structure 26 is provided at the inside portion of the speaker snout 8 near the second opening 18. The fixation structure 26 is configured to engage with (and thus be received by) a corresponding fixation structure 25 provided in a plane side structure 28 of the ear wax filter 20. A flange 10 is provided in the distal end of the speaker snout 8. A centrally arranged sound canal opening 14 is provided in the flange 10.

The ear wax filter 20 comprises two arced side structures 30 provided in the end of the ear wax filter 20 that will constitute a closing structure that closes the openings 16, 18. The arced side structures 30 are configured to be arranged in such a manner that the side structures 30 are aligned with the surrounding structures of the speaker snout 8, when the ear wax filter 20 has been inserted into the speaker snout 8.

The ear wax filter 20 comprises two parallel side structures 34, 36 that extend perpendicular to the longitudinal axis X of the sound canal of the speaker snout 8. The ear wax filter 20 comprises two opposing, parallel plane side structures 28 extending perpendicular to the two parallel side structures 34, 36 of the ear wax filter 20. Accordingly, the plane side structures 28, 34, 36 can be brought into a configuration, in which the plane side structures 28, 34, 36 abut corresponding plane sides of the speaker snout 8.

The ear wax filter 20 comprises a solid structure 19 surrounding a centrally arranged through-going lattice structure 23 extending through the ear wax filter 20. The lattice structure 23 has a filter function as it allows sound waves to pass through the sound canal and at the same time prevents ear wax from passing through the ear wax filter 20. Several of through-going canals are provided in the lattice structure 23.

FIG. 1B illustrates a cross-sectional view of a portion of a hearing aid according to the disclosure. The hearing aid comprises a portion corresponding to the one shown in FIG. 1A. It can be seen that an ear wax filter 20 has been mounted in the speaker snout 8. The ear wax filter 20 is arranged close to a flange 10 of the speaker snout 8. An earpiece (a dome 24) has been detachably attached to the speaker snout 8. The dome 24 has a receiving structure that has received a portion of the flange 10. The flange 10 and the corresponding receiving structure of the dome 24 provide matching mechanical fixation structures that enable a firm attachment of the dome 24 to the speaker snout 8. The speaker snout 8 forms part of the speaker body 4 of the hearing aid.

Figure 2B:
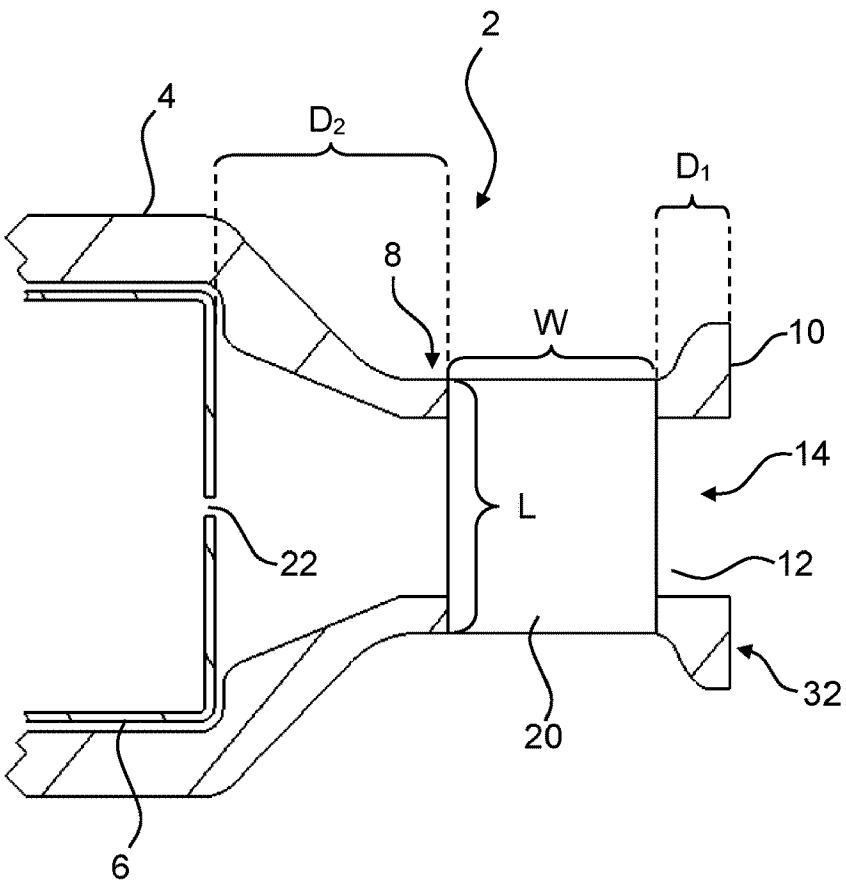
FIG. 2B shows a cross-sectional view of the hearing aid shown in FIG. 2A, in a configuration in which the ear wax filter has been inserted.
Figure 2A:
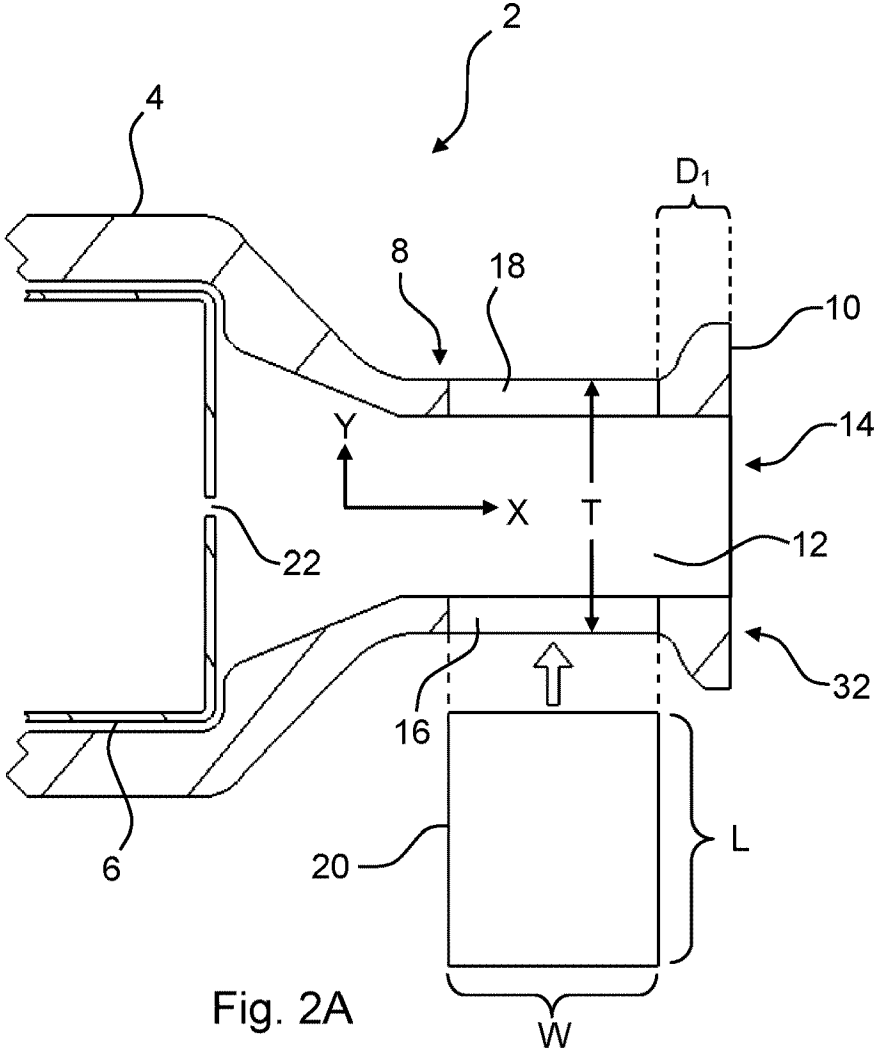
FIG. 2A shows a cross-sectional view of a hearing aid according to the disclosure while an ear wax filter is being inserted.

FIG. 2A illustrates a cross-sectional view of a hearing aid 2 according to the disclosure while an ear wax filter 20 is being inserted. FIG. 2B illustrates a cross-sectional view of the hearing aid 2 shown in FIG. 2A, in a configuration in which the ear wax filter 20 has been inserted.

The hearing aid 2 comprises a speaker body 4 comprising a speaker snout 8. A speaker unit 6 provided with a centrally arranged sound opening 22 is housed in the speaker body 4. The speaker snout 8 comprises a conical portion provided next to the speaker unit 6. The speaker snout 8 further comprises a straight portion having a constant cross-sectional area, wherein the straight portion is provided as the distal portion of the speaker snout 8 arranged adjacent to the conical portion. A first opening 16 and a second opposite opening 18 are provided in the straight portion of the speaker snout 8.

It can be seen that the speaker snout 8 comprises a sound canal 12 having a longitudinal axis X and a lateral axis Y extending perpendicular to the longitudinal axis X. The sound canal 12 extends from the distal portion 32 of the speaker snout 8 where the sound canal opening 14 is provided, to the speaker unit 6. The sound canal 12 is configured to guide sound generated by the speaker unit 6 through the sound canal 12 and out through the sound canal opening 14.

Both openings 16, 18 are provided in a non-zero distance $D_1$ from the distal portion 32 of the speaker snout 8. It can be seen that the non-zero distance $D_1$ is smaller than the width W of the ear wax filter 20. The openings 16, 18 are both provided in a non-zero distance $D_2$ from the speaker unit 6. In FIG. 2B it can be seen that the distance $D_1$ basically corresponds to the distance $D_2$.

The length L of the ear wax filter 20 correspond to the thickness T of the straight portion of the speaker snout 8. The speaker snout 8 is provided with a flange 10 that is configured to receive an earpiece (as shown in FIG. 1B).

The ear wax filter 20 can be slidably arranged in the speaker snout 8 through the first opening 16 allowing the ear wax filter 20 to be radially inserted into the sound canal 12. Furthermore, the second opening 18 allows the ear wax filter 20 to be radially removed from the sound canal 12.

Figure 3A:
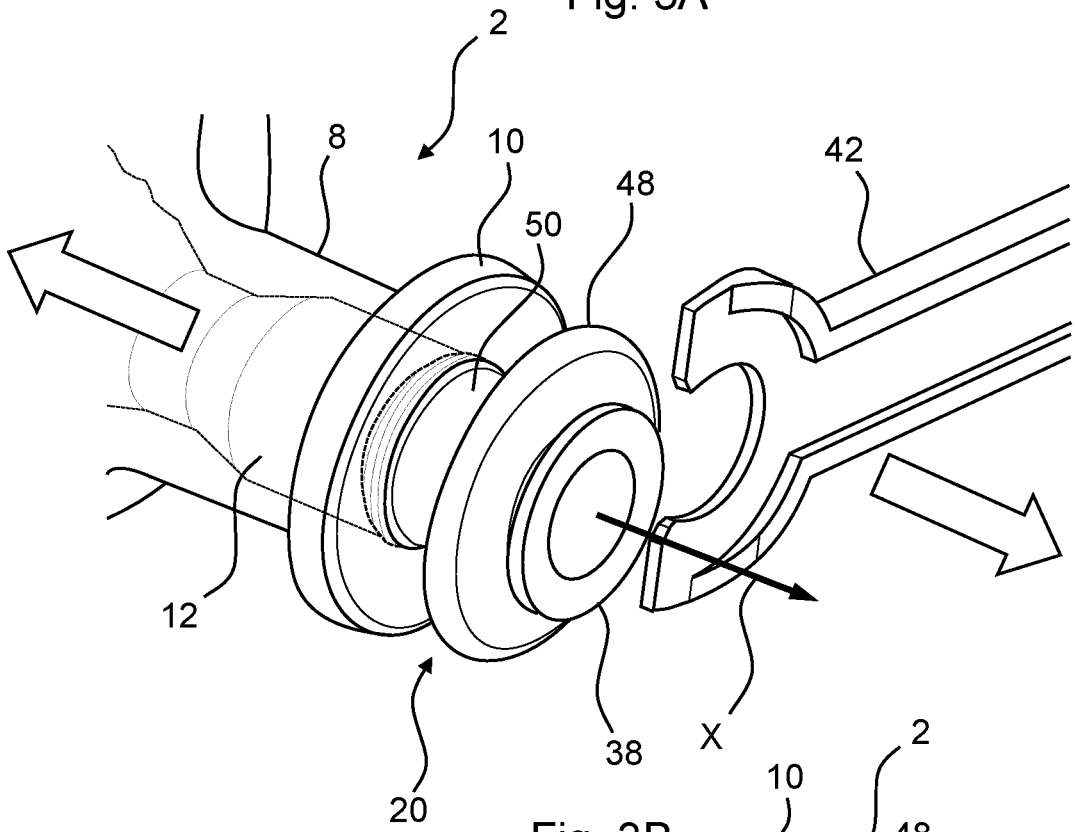
FIG. 3A shows a perspective view of a portion of a hearing aid according to the disclosure.

FIG. 3A illustrates a perspective view of a portion of a hearing aid 2 according to the disclosure. The hearing aid 2 comprises a speaker snout 8 comprising a centrally arranged sound canal 12. A flange 10 is provided at the distal end of the speaker snout 8.

An ear wax filter 20 has been partly inserted into the sound canal 12. The ear wax filter 20 comprises a cylindrical body portion 50. A first annular flange 48 extends perpendicular to the longitudinal axis X of the sound canal 12 of the speaker snout 8. An additional annular flange 38 extends parallel to the first annular flange 48. The additional annular flange 38 is spaced from the first annular flange 48. Accordingly, a tool 42 having an engagement fork configured to be inserted into the groove between the additional annular flange 38 and the first annular flange 48, is shown next to the hearing aid 2. The tool 42 makes it easier to replace the ear wax filter 20. In one embodiment, the additional annular flange 38 is spaced 0.1-0.3 mm, preferably approximately 0.2 mm from the first annular flange 48.

Figure 3B:
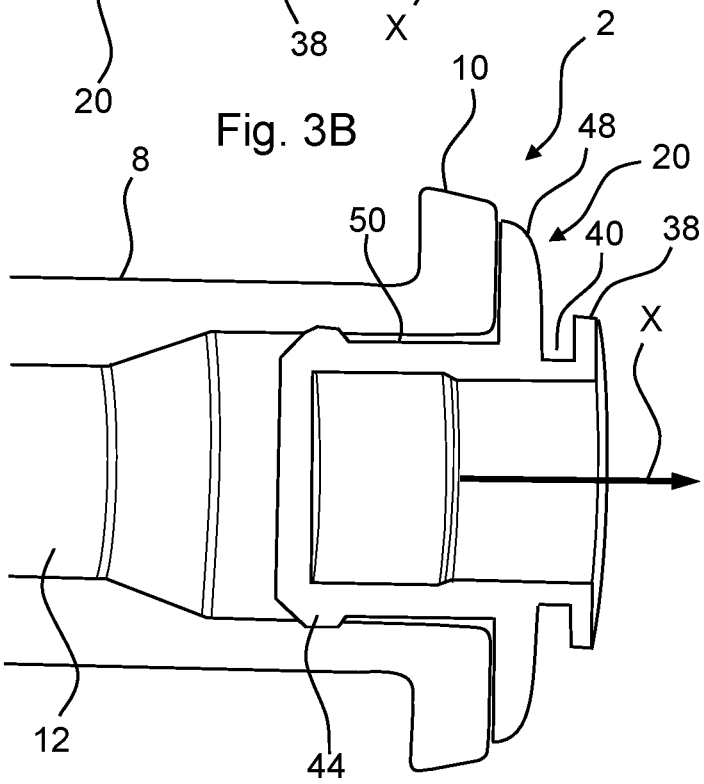
FIG. 3B shows a cross-sectional view of the hearing aid shown in FIG. 3A.

FIG. 3B illustrates a cross-sectional view of the hearing aid 2 shown in FIG. 3A, in a configuration, in which the ear wax filter 20 has been fully inserted into the sound canal 12 of the speaker snout 8. The ear wax filter 20 comprises an annular attachment structure 44 protruding from the body portion 50 of the ear wax filter 20. The annular attachment structure 44 has been brought into engagement with a corresponding receiving structure provided in the speaker snout 8.

The first annular flange 48 of the ear wax filter 20 is brought into contact with the flange 10 of the speaker snout 8. It can be seen that the first annular flange 48 and second annular flange 38 extend perpendicular to the longitudinal axis X of the sound canal 12 and that the groove 20 has an annular shape.

Figure 4:
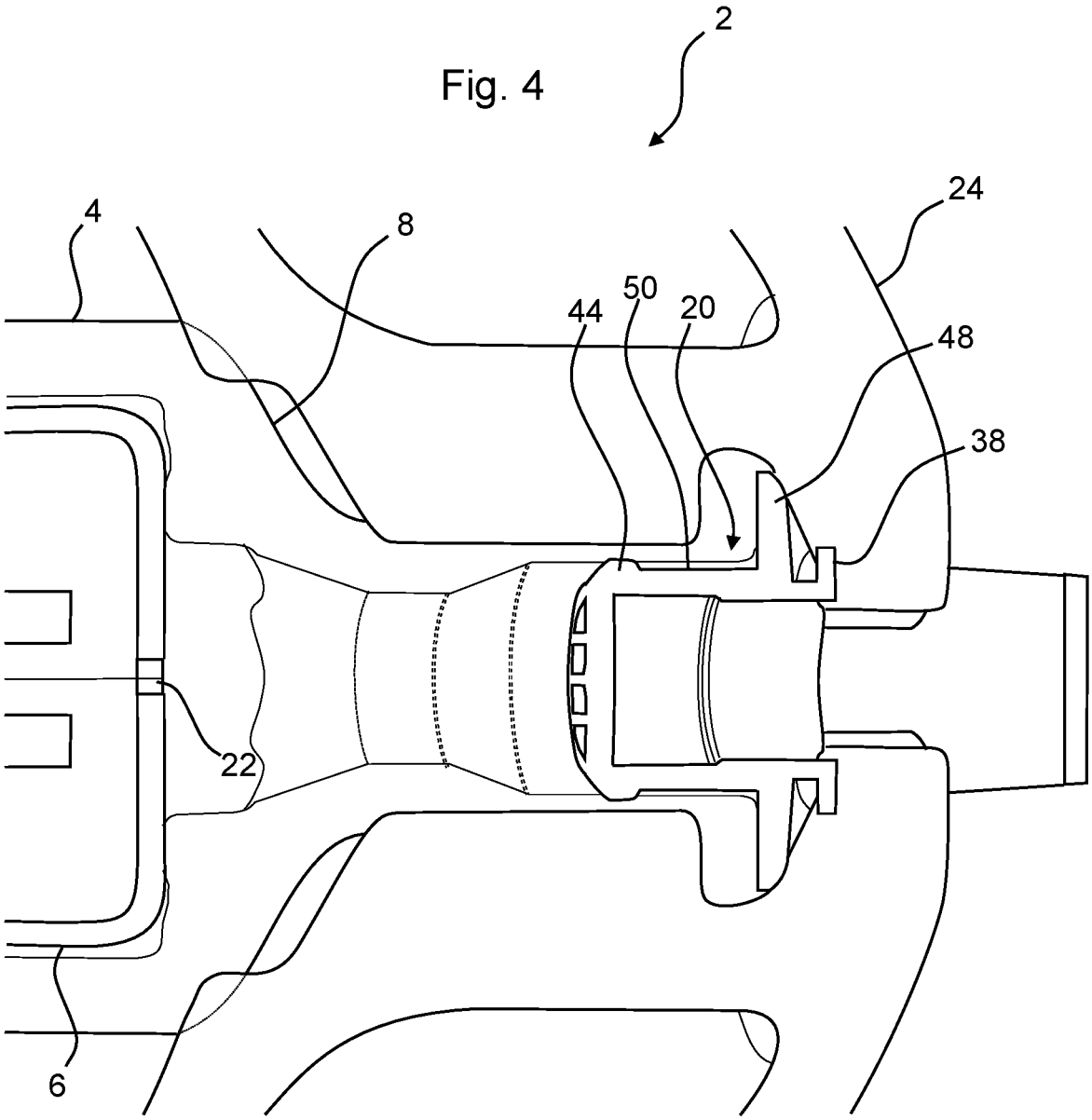
FIG. 4 is another view of the hearing aid shown in FIG. 3B.

FIG. 4 illustrates another view of the hearing aid 2 shown in FIG. 3B. A dome 24 has been attached to the speaker snout 8. The ear wax filter 20 comprises an annular attachment structure 44 that has been brought into engagement with a corresponding receiving structure provided in the speaker snout 8.

The hearing aid 2 is provided with a speaker body 4 housing a speaker snout 8. A speaker unit 6 is provided in the speaker body 4.

Figures 5A, 5B:
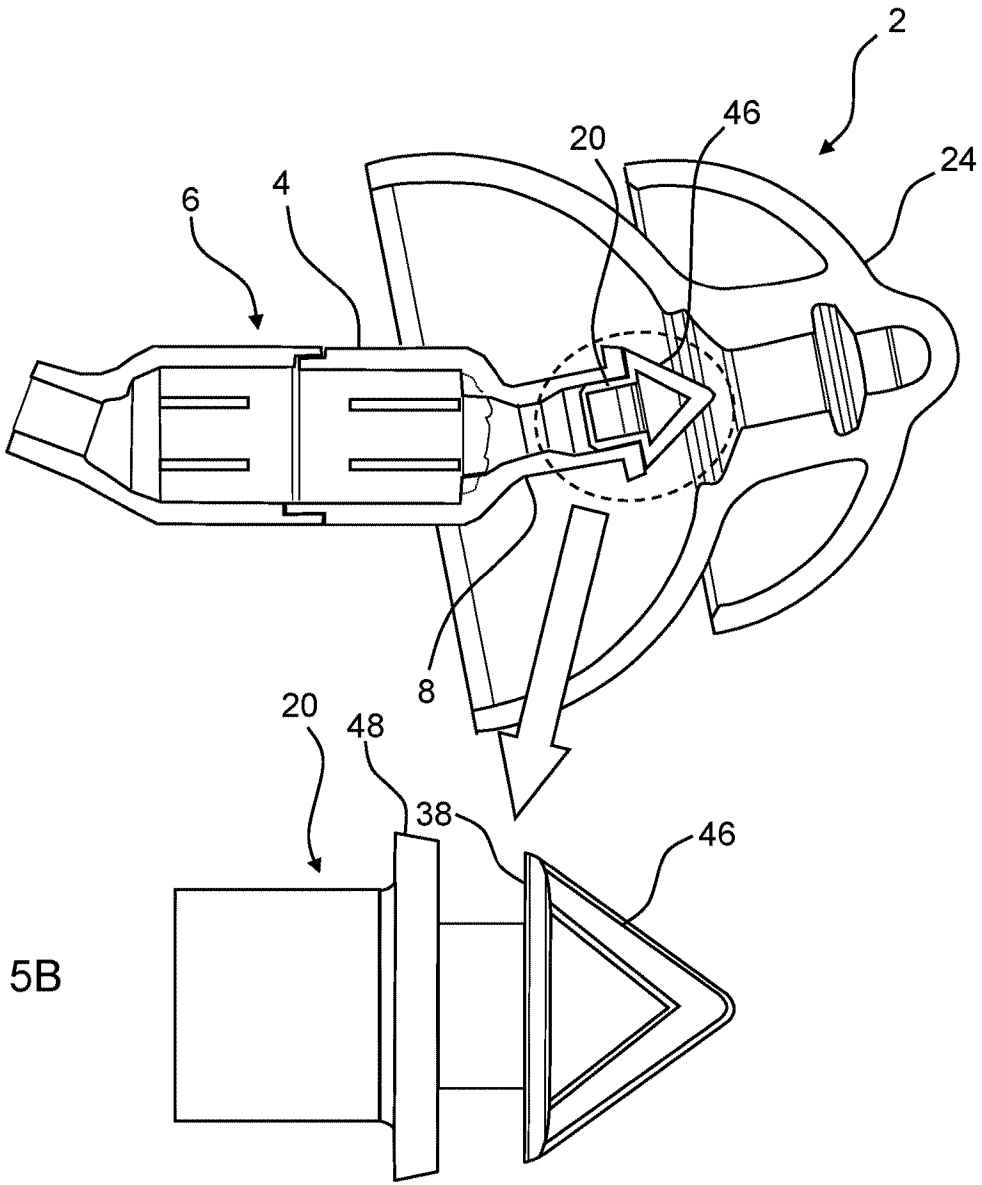
FIG. 5A shows a cross-sectional view of a hearing aid according to the disclosure and FIG. 5B shows a close-up view of the filter of the hearing aid.

FIG. 5A illustrates a cross-sectional view of a hearing aid 2 according to the disclosure. The hearing aid 2 comprises a speaker body 4 comprising a speaker unit 6. The hearing aid 2 comprises a speaker snout 8 that is part of the speaker body 4.

An ear wax filter 20 provided with a demounting structure 46 arranged in the distal end of the ear wax filter 20 is protruding towards the distal portion of the dome 24 that has been attached to the speaker snout 8.

The demounting structure 46 has a triangular shape. In another embodiment, the demounting structure 46 is shaped as a semicircular shape or another shape.

FIG. 5B illustrates a close-up view of an ear wax filter 20 that basically corresponds the one shown in FIG. 5A. The ear wax filter 20 comprises a first flange 48. In one embodiment, the first flange 48 has an annular shape. In another embodiment, the first flange 48 has a rectangular shape. Alternatively, the first flange 48 may be oval, triangular, hexagonal or octagonal. The ear wax filter 20 comprises a comprises a second flange 38 provided in a distance from the first flange 48. The demounting structure 46 enables the hearing aid user to mount the dome 24 on the speaker unit 6.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element, but an intervening element may also be present, unless expressly stated otherwise. Furthermore, "connected" or "coupled" as used herein may include wirelessly connected or coupled. As used herein, the term "and/or" includes any and all combinations of one or more of the associated listed items.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing aid comprising:

a speaker unit;

a speaker snout defining a sound canal having a longitudinal axis, a lateral axis and a sound canal opening, an earpiece configured to be attached to the speaker snout and an ear wax filter, said sound canal being configured to guide sound generated by the speaker unit through the sound canal into the earpiece, wherein the ear wax filter is detachably arranged in the speaker snout so that said ear wax filter is slidably insertable into and slidably removable from said sound canal through at least one first opening in the speaker snout, thereby allowing the ear wax filter to be radially inserted into and radially removed from the sound canal.

2. Hearing aid according to claim 1, wherein the ear wax filter comprises a first fixation structure configured to engage with a corresponding second fixation structure of said speaker snout.

3. Hearing aid according to claim 2, wherein the first fixation structure is an indentation structure and the second fixation structure is a protruding structure.

4. Hearing aid according to claim 2, wherein the first fixation structure is a protruding structure and the second fixation structure is an indentation structure.

5. Hearing aid according to claim 2, wherein the first fixation structure and the second fixation structure extend along the longitudinal axis of the speaker snout.

6. Hearing aid according to claim 1, wherein the ear wax filter comprises two parallel plane side structures configured to engage into the first opening of the speaker snout.

7. Hearing aid according to claim 1, wherein the ear wax filter comprises at least one arced side structure that constitutes a substantially flush surface with the speaker snout when the ear wax filter is arranged in the first opening.

8. Hearing aid according to claim 1, wherein the speaker snout is provided with a first opening allowing the ear wax filter to be radially inserted into the sound canal through the first opening, and a second opening allowing the ear wax filter to be radially removed from the sound canal through said second opening.

9. Hearing aid according to claim 8, wherein the area of the first opening corresponds to the area of the second opening.

10. Hearing aid according to claim 1, wherein the ear wax filter is arranged in a non-zero distance from the distal portion of the speaker snout, wherein the non-zero distance is smaller than the width of the ear wax filter.

11. Hearing aid according to claim 1, wherein the length of the ear wax filter essentially corresponds to the thickness of the speaker snout.

12. Hearing aid according to claim 1, wherein the ear wax filter is arranged in a non-zero distance from the speaker unit, wherein the non-zero distance is larger than or equal to the width of the ear wax filter.

13. Hearing aid according to claim 1, wherein the speaker snout comprises a flange configured to receive said earpiece and where a plane surface of the ear wax filter is arranged in said first opening so as to abut a surface of the flange.

14. Hearing aid according to claim 1, wherein the ear wax filter is provided with a centrally arranged filtration zone comprising a lattice structure comprising a plurality of through-going bores.

15. Hearing aid according to claim 14, wherein a solid structure surrounds the centrally arranged lattice structure.

16. Hearing aid according to claim 3, wherein the first fixation structure and the second fixation structure extend along the longitudinal axis of the speaker snout.

17. Hearing aid according to claim 4, wherein the first fixation structure and the second fixation structure extend along the longitudinal axis of the speaker snout.

18. Hearing aid according to claim 2, wherein the ear wax filter comprises two parallel plane side structures configured to engage into an opening of the speaker snout.

19. Hearing aid according to claim 3, wherein the ear wax filter comprises two parallel plane side structures configured to engage into an opening of the speaker snout.

20. Hearing aid according to claim 4, wherein the ear wax filter comprises two parallel plane side structures configured to engage into an opening of the speaker snout.

* * * * *